US007566028B2

(12) United States Patent
Johnson

(10) Patent No.: US 7,566,028 B2
(45) Date of Patent: Jul. 28, 2009

(54) INTEGRAL LOCKING MECHANISM FOR DEPLOYABLE DEVICE

(75) Inventor: Gary H. Johnson, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 330 days.

(21) Appl. No.: 11/586,893

(22) Filed: Oct. 26, 2006

(65) Prior Publication Data

US 2008/0099598 A1 May 1, 2008

(51) Int. Cl.
*F42B 15/01* (2006.01)

(52) U.S. Cl. ..... 244/3.28

(58) Field of Classification Search ..... 244/3.24–3.29, 244/46; 403/326, 329
See application file for complete search history.

(56) References Cited

U.S. PATENT DOCUMENTS 4,714,216 A * 12/1987 Meston et al. ..... 244/3.29

7,083,140 B1 * 8/2006 Dooley ..... 244/3.27

* cited by examiner

*Primary Examiner*—Michael R Mansen
*Assistant Examiner*—Michael Kreiner
(74) *Attorney, Agent, or Firm*—Renner, Otto, Boisselle & Sklar, LLP

(57) ABSTRACT

A guided projectile has a deployment system for deploying a deployable structure, such as a fin, another type of control surface, or an antenna. The deployment system includes a single-piece body that has a hub body and a resilient tab. The resilient tab presses against a stepped surface of a guided projectile body. As the deployable structure is extended, the deployable structure body rotates about a shaft in a central hole or aperture in the hub body. The resilient tab presses against the stepped surface on one side of an edge of the stepped surface during a first (relatively stowed) part of this deployment. At a certain point, as the contact between the tab and the stepped surfaces reaches the edge (the step of the stepped surface), the resilient tab changes position. The change in position of the resilient tab keeps the deployable structure from retracting again.

18 Claims, 5 Drawing Sheets

INTEGRAL LOCKING MECHANISM FOR DEPLOYABLE DEVICE

BACKGROUND OF THE INVENTION

1. Field of the Invention

The invention in general relates to locking mechanisms for deployable devices. In particular the invention relates to locking mechanisms for devices deployable in an airstream.

2. Description of the Related Art

Guided powered or unpowered projectiles often employ structures that are stowed during launch, and deploy only during flight. Examples of such structures include fins, various types of control systems, and communication antennas. Such structures are deployed during launch, for example in slots or recesses, in order for the guided projectile to fit in a launch tube having a regular shape, for example having a circular shape. The fins, control surfaces, or other structures deploy passively or actively after launch. Passive deployment involves use of spring forces or aerodynamic forces to automatically deploy the deployable structure upon exit of the launch tube and/or initiation of flight. Active deployment involves a separate force generator, such as an electric motor, a hydraulic actuator, or an explosive device, to accomplish deployment of the deployable structure.

One method of controlling deployment has been to use a spring-loaded pin in a recess on the deployable structure. At some desired deployed location the spring-loaded pin engages a stop. This involves use of multiple parts (at least a pin and a spring), and machining a hole in a part.

It will be appreciated that improvements may be desirable in regard to devices, systems, and methods for deploying structures.

SUMMARY OF THE INVENTION

According to an aspect of the invention, a single-piece body of a deployable guided projectile structure includes a hub portion and a resilient tab.

According to another aspect of the invention, a deployment system for deploying a deployable structure on a guided projectile includes: a single-piece body of the deployable structure, wherein the body includes a hub body portion, and a resilient tab that is attached to the hub body portion at one end; and a guided projectile body having a stepped surface having a step with an edge. The resilient tab presses against the stepped surface during deployment of the deployable structure, and shifts position when going over the step.

According to yet another aspect of the invention, a deployment system for deploying a deployable structure on a guided projectile includes: a single-piece body of the deployable structure, wherein the body includes a hub body portion, and a resilient tab that is attached to the hub body portion at one end; and a guided projectile body having a stepped surface having a step with an edge. The resilient tab presses against the stepped surface during deployment of the deployable structure, and shifts position when going over the step. The resilient tab is an elongate member having a length in a direction away from where an attached end of the resilient tab attaches to the hub body portion, that is greater than a width or a height of the resilient tab. The elongate member includes a straight portion and a curved portion. The straight portion is a proximal straight portion that includes the attached end. The curved portion is a distal curved portion that is farther from the attached end than the straight portion. The distal curved portion includes a free end of the resilient tab. A slot between the elongate member and part of the hub body portion has a substantially constant width. The resilient tab has a side surface that presses against the stepped surface on a first side of the edge, when the deployable structure is in a relatively stowed configuration. The resilient tab has an end surface at a free end configured to engage the stepped surface on a second side of the edge when the deployable structure is in a relatively deployed configuration. The resilient tab includes a protuberance at the free end. The side surface and the end surface are on the protuberance.

According to still another aspect of the invention, a method of deploying a deployable structure of a guided projectile, includes: deforming a resilient tab of a single-piece body of the deployable structure, as the deployable structure rotates about a hub body portion of the deployable structure, with the deployable structure in a relatively stowed configuration; and in a relatively deployed configuration, reversing the deformation of the resilient tab as a free end of the resilient tab passes over an edge of a step in a stepped surface of a guided projectile body of the guided projectile body, thereby preventing reversal of the deployment of the deployable structure.

According to a further aspect of the invention, a deployment system for deploying a deployable structure on a guided projectile includes: a body of the deployable structure, and a guided projectile body having a stepped surface that includes a step with an edge. The body includes: a hub body portion; and a resilient tab that is attached to the hub body portion at one end. The resilient tab presses against the stepped surface during deployment of the deployable structure, and shifts position when going over the step.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

A guided projectile has a deployment system for deploying a deployable structure, such as a fin, another type of control surface, or an antenna. The deployment system includes a single-piece body that has a hub body and a resilient tab, which is attached to the hub body on one end. The resilient tab presses against a stepped surface of a guided projectile body of the guided projectile. As the deployable structure is extended, the deployable structure body rotates about a shaft in a central hole or aperture in the hub body. The resilient tab presses against the stepped surface on one side of an edge of the stepped surface during a first part of this deployment. At a certain point, as the contact between the tab and the stepped surfaces reaches the edge (the step of the stepped surface), the resilient tab changes position. This change in position involves engaging the stepped surface differently, if at all. The change in position of the resilient tab keeps the deployable structure from retracting again. The position change of the resilient tab may also lock the deployable structure in place, preventing further extension of the deployable structure. To lock the deployable structure into place, the stepped surface may have a notch that the resilient tab engages. The resilient tab may be an elongate structure that is attached to the hub body at one end, and has a free end at the opposite end. The resilient tab may be separated from the hub body by a slot, which may have substantially the same shape as the resilient tab. The one or more side surfaces of the resilient tab may engage the stepped surface on one side of the edge of the step during the early phases of deployment. A flat end surface of the resilient tab may engage the stepped surface on the other side of the edge during later stages of the deployment. The resilient tab may have a straight portion and a curved portion, and may have a protuberance at its free end.

Referring to FIGS. 1-4, a guided projectile 10 has a guided projectile body 12 that has a deployment system 14 for deploying a number of fins 16 into an airstream after launch of the guided projectile 10. The fins 16 shown are only one example of a more general class of deployable structures, including other sorts of control surfaces, such as wings, rudders, canards, etc., as well as antennas and the like.

Figure 1:
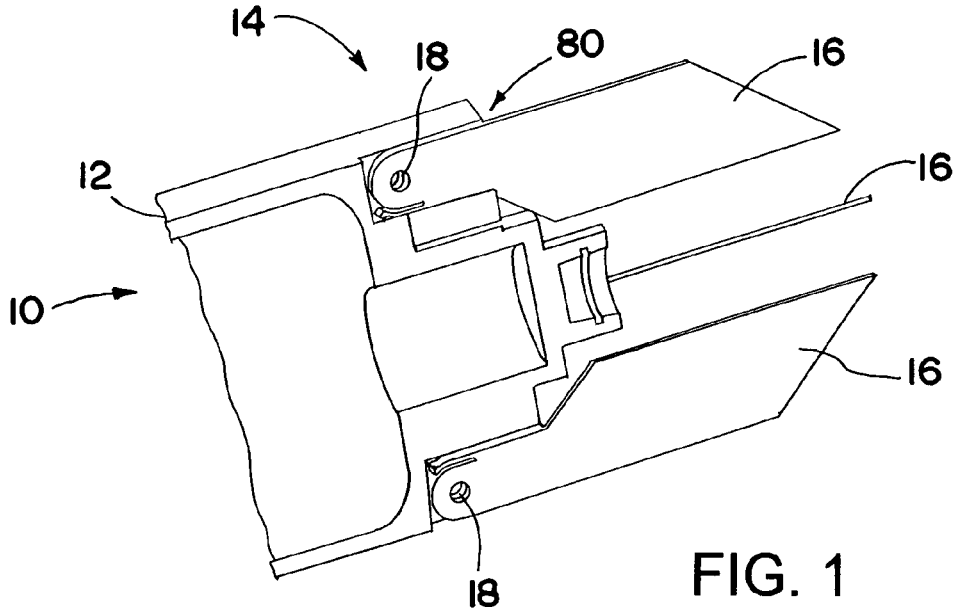
FIG. 1 is a cutaway oblique view of a portion of a guided projectile with a deployment system in accordance with an embodiment of the present invention, with fins in a stowed configuration.
Figure 2:
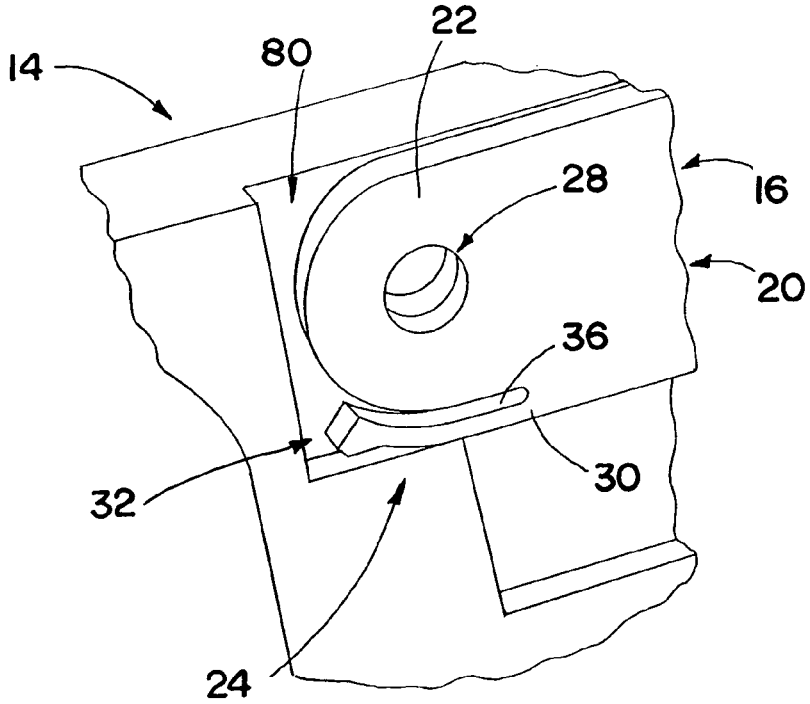
FIG. 2 is a magnified view of a portion of FIG. 1.

FIGS. 1 and 2 show the fins 16 in a stowed configuration, such as is used during launch of the guided projectile 10. In the stowed configuration the fins 16 do not extend radially outward of a generally cylindrical shape of the guided projectile body 12. In the illustrated embodiment the fins 16 are shown as folded inward behind the guided projectile body 12. However it will be appreciated that alternatively the fins 16 (or other deployable surfaces) may be stowed in other ways, such as being located in slots or recesses of the guided projectile body 12.

Figure 3:
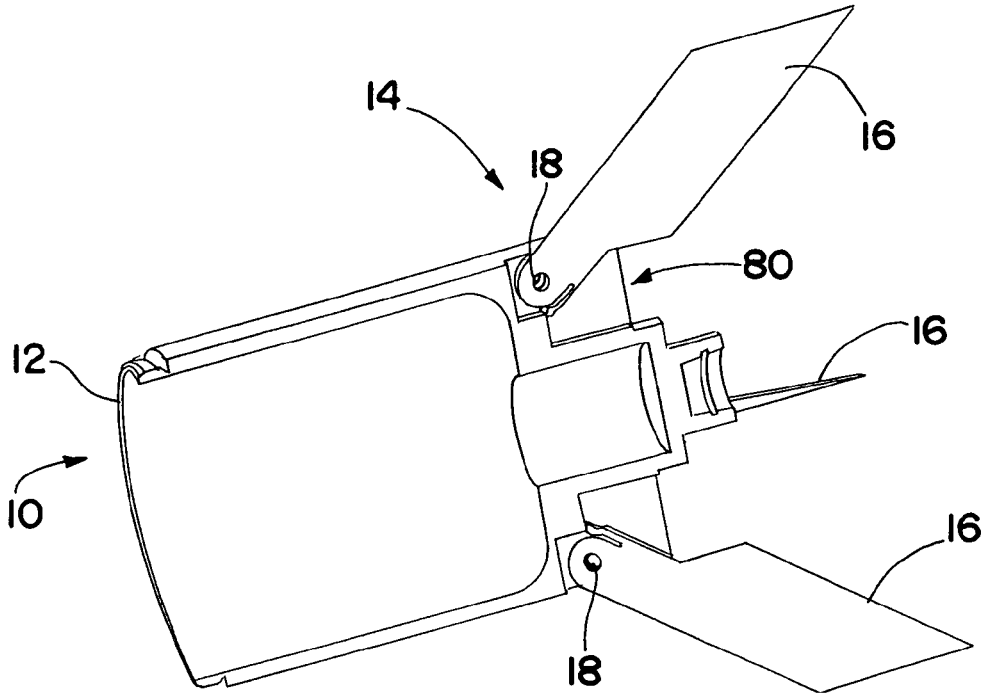
FIG. 3 is a cutaway oblique view of the guided projectile portion shown in FIG. 1, with the fins in a deployed configuration.
Figure 4:
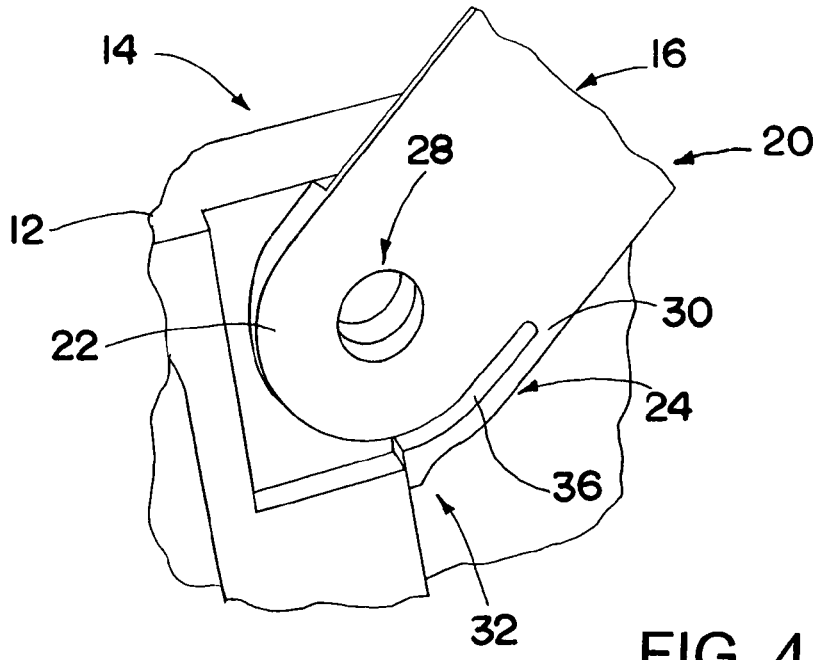
FIG. 4 is a magnified view of a portion of FIG. 3.

FIGS. 3 and 4 show the fins 16 in a deployed configuration, with the fins 16 having been rotated outward to extend radially outside the shape of the guided projectile body 12, into the airstream around the guided projectile 10. The fins 16 may be deployed actively or passively upon launch of the guided projectile 10. It will be appreciated that a number of well-known passive and active deployment methods exist, for example using aerodynamic forces or spring forces to automatically deploy the fins 16 upon exit by the guided projectile 10 from a launch tube. The fins 16 may be deployed by rotating them about shafts 18, although it will be appreciated that the fins 16 may be deployed by other additional or alternative motions.

Figure 5:
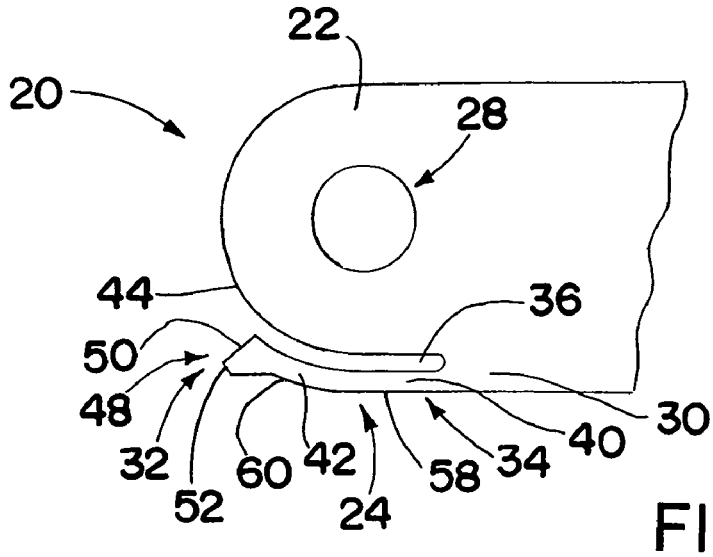
FIG. 5 is a plan view of a single-piece body of the deployment system of FIG. 1.

Referring now in addition to FIG. 5, further details of one of the fins 16 are discussed. With reference to one of the fins 16, the fin 16 has a single-piece body 20 with a hub body portion 22 and resilient tab 24. The term "single-piece body" is defined herein as a body made from a single-piece of material or the equivalent. A body from a single continuous piece of solid material qualifies as a "single-piece body." Two or more separate pieces of material that are fixedly attached together so to behave in a manner similar to a single piece of material are also included in the definition of a single-piece body.

The hub body portion 22 has a central hole or aperture 28 for receiving the shaft 18. With the hub body portion 22 mounted on the shaft 18, the single-piece body 20 may be rotated to deploy the fin 16. The entire fin 16 may be made from a single piece of material, such as being a cast or composite material part. Alternatively, the fin 16 may have other pieces attached or otherwise joined to the single-piece body 20.

The resilient tab 24 has an attached first end 30, where it joins to the hub body portion 22. At its opposite end, the resilient tab 24 has a free end 32. The tab 24 has an elongate tab body or member 34 that is separated from the hub body portion 22 by a slot 36. The elongate tab body 34 has a length in a direction from the attached end 30 to the free end 32 that is greater than a width or a height of the tab body 34.

The tab body 34 includes a straight proximal portion 40 and a curved distal portion 42. The straight proximal portion 40 is closer to the attached end 30. The curved distal portion 42 is closer to the free end 32. The curved distal portion 42 may have a shape so as to be substantially parallel to a rounded outer surface 44 of the hub body portion 22. The resilient tab 24 may be substantially parallel to the hub body portion 22, with the slot 36 having a substantially uniform width between the resilient tab 24 and the hub body portion 22.

The resilient tab 24 has a protuberance 48 at the free end 32. The protuberance 48 has a substantially flat end surface 50, and a substantially flat side surface 52. The surfaces 50 and 52 may be employed in engaging a stepped surface 56 of the guided projectile body 12, as described in detail below. The resilient tab also has a straight portion outer side surface 58, and a curved portion outer side surface 60.

The single-piece body 20 may be made of any of a variety of suitable materials, such as suitable metals, for example steel, or suitable composite materials. It will be appreciated that the illustrated configuration of the single-piece body 20, and in particular the resilient tab 24, is only one specific configuration from a large variety of suitable configurations.

Figure 6:
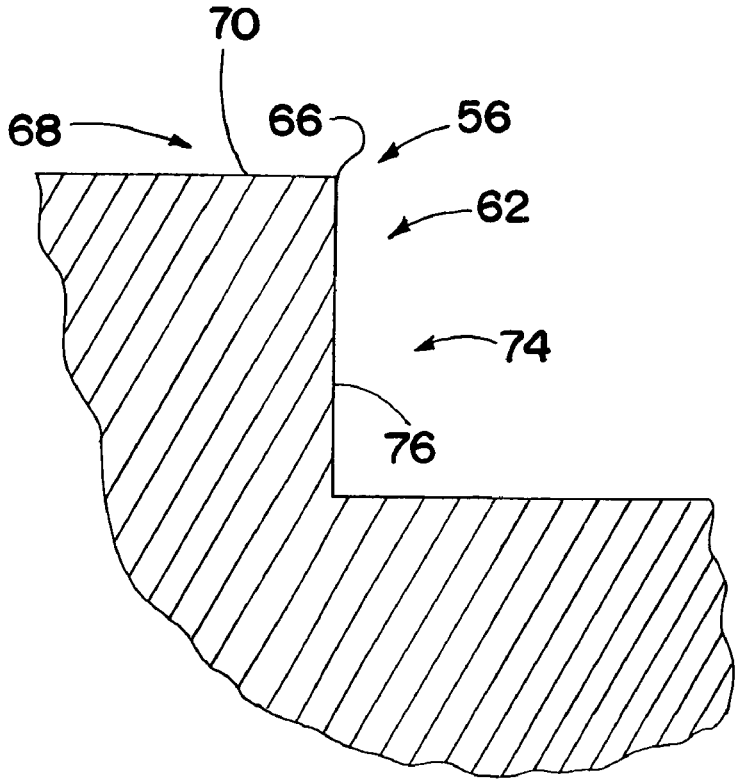
FIG. 6 is a sectional view of a stepped surface of the deployment system of FIG. 1.

Referring now in addition to FIG. 6, details are shown of one possible configuration of the stepped surface 56. The stepped surface 56 includes a step 62, a break in the smoothness of the stepped surface 56, with an edge 66 marking the boundary of the step 62. On one side 68 of the edge 66 is a first portion or surface 70 of the stepped surface 56. On the other side 74 of the edge 66 there is a second portion or surface 76 of the stepped surface 56.

The stepped surface 56 is part of the walls of a cavity or recess 80 in the guided projectile body 12 that houses the hub body 22 and the resilient tab 24. When the fin 16 is in the stowed condition, the straight portion side surface 58 is near to or rests against the first surface portion 70. As the fin 16 rotates counterclockwise to begin the deployment process the straight portion side surface 58 rotates away from the first stepped surface portion 70. Initially, the curved portion side surface 60 moves along the first stepped surface portion 70. Then the tab protuberance 48 comes into contact with the first stepped surface portion 70. The causes the protuberance 48 to be pressed inward, toward the hub body hole 28. This resiliently bends the resilient tab 24 inward, partially into the slot 36. The tab 24 is fixed at the attached end 30, and bends like a cantilevered beam subjected to a force at a free end. Eventually the protuberance side surface 52 may press flush against the first stepped surface portion 70, and may slide along the first stepped surface portion 70.

When the protuberance side surface 52 reaches the step 62, and passes the edge 66, it passes the end of the surface portion 70. The tab 24 is no longer bent inward from the force from the surface portion 70. Thus the tab 24 bends back outward. Any attempt to rotate the fin 16 in the opposite clockwise direction causes the protuberance end surface 50 to bear against the second stepped surface portion 76, blocking further rotation in that direction. It will be appreciated that the resilient tab 24 is configured to oppose a compression force against the protuberance end surface 50 much better than a bending force on the protuberance side surface 52.

Figure 7:
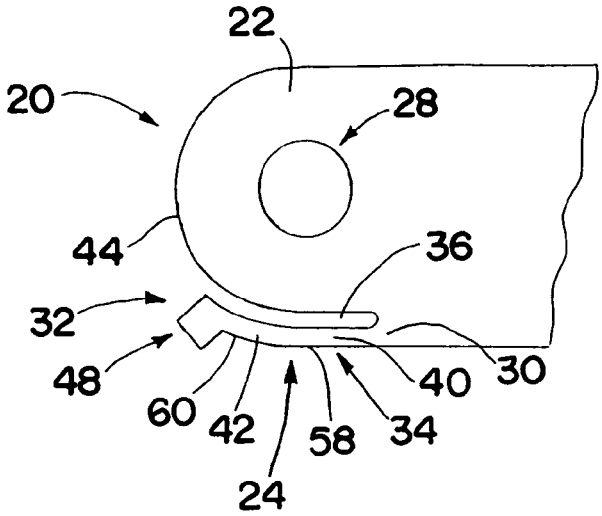
FIG. 7 is a plan view of an alternate embodiment single-piece body usable with the deployment system of FIG. 1.
Figure 8:
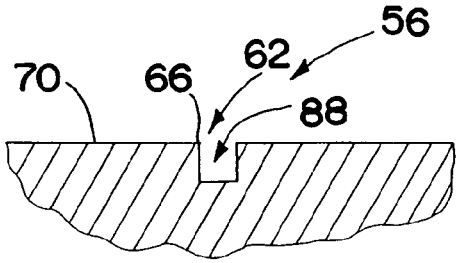
FIG. 8 is a sectional view of an alternate embodiment stepped surface usable with the deployment system of FIG. 1.

FIGS. 7 and 8 show an alternate embodiment in which the stepped surface 56 includes a notch 88, and in which the protuberance 48 has a squared-off shape that corresponds to the shape of the notch 88. The notch 88 is configured to securely hold the protuberance 48, such that when the protuberance 48 enters the notch 88, further rotation of the fin 16 in either direction is prevented. The process by which the tab 24 shown in FIG. 7 passes over the edge 62 and the step 66, and into the notch 88, may be similar to that described above with regard to other embodiments.

Figure 9:
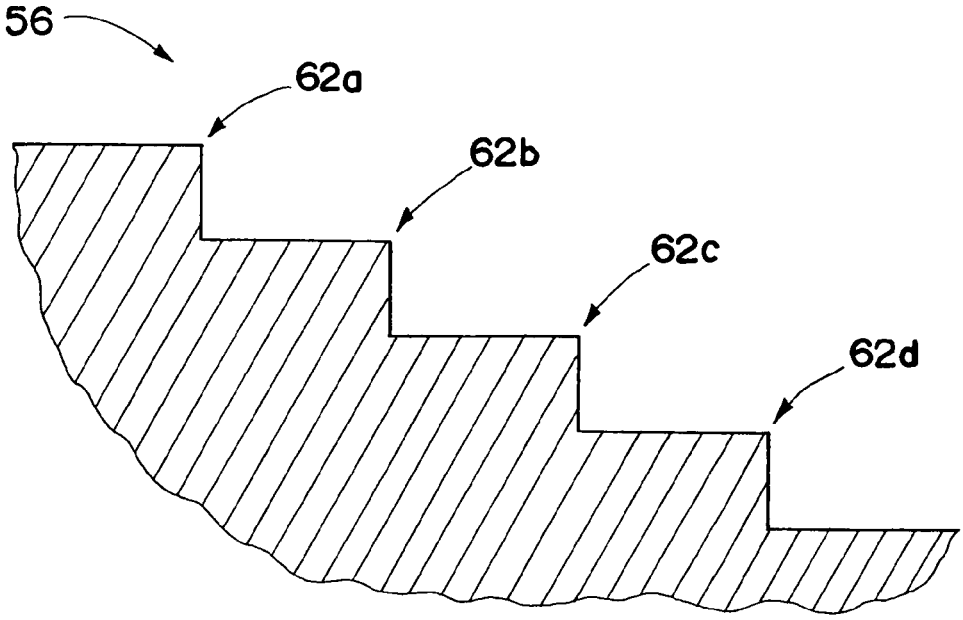
FIG. 9 is a sectional view of another alternate embodiment stepped surface usable with the deployment system of FIG. 1.

FIG. 9 shows another embodiment, wherein a stepped surface 56' has multiple steps 62*a*, 62*b*, 62*c*, and 62*d*. The stepped surface 56' prevents reversal of motion of the fin 16 (FIG. 1) at multiple locations (the steps 62*a*-62*d*) along its deployment. It will be appreciated that other numbers steps may be utilized.

Figure 10:
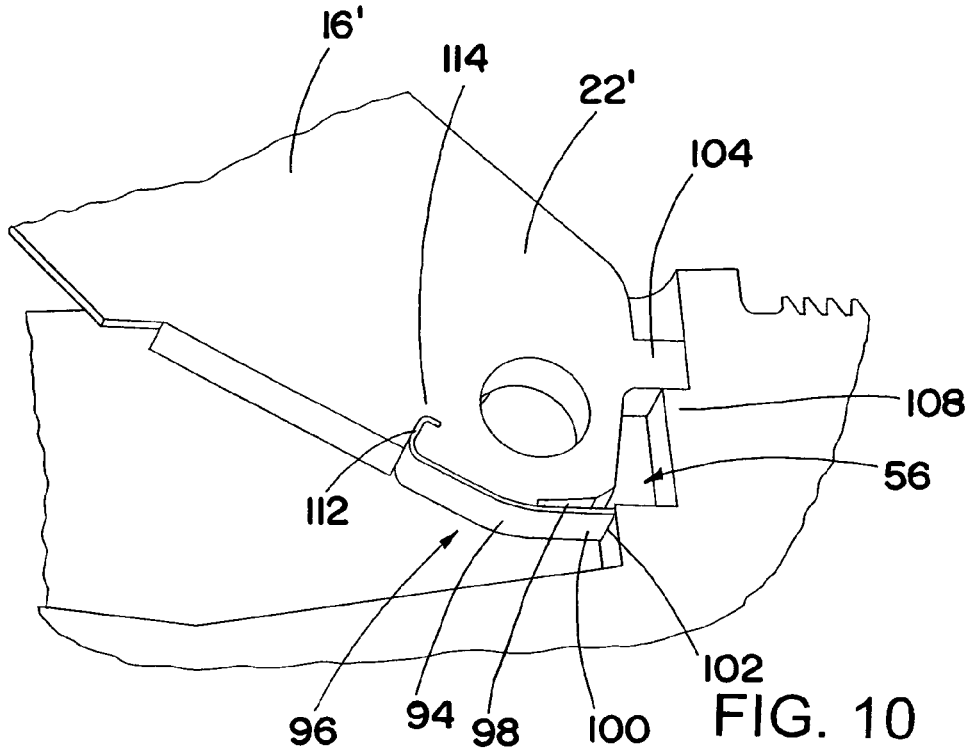
FIG. 10 is an oblique view of a portion of a guided projectile with a deployment system in accordance with another embodiment of the present invention.
Figure 11:
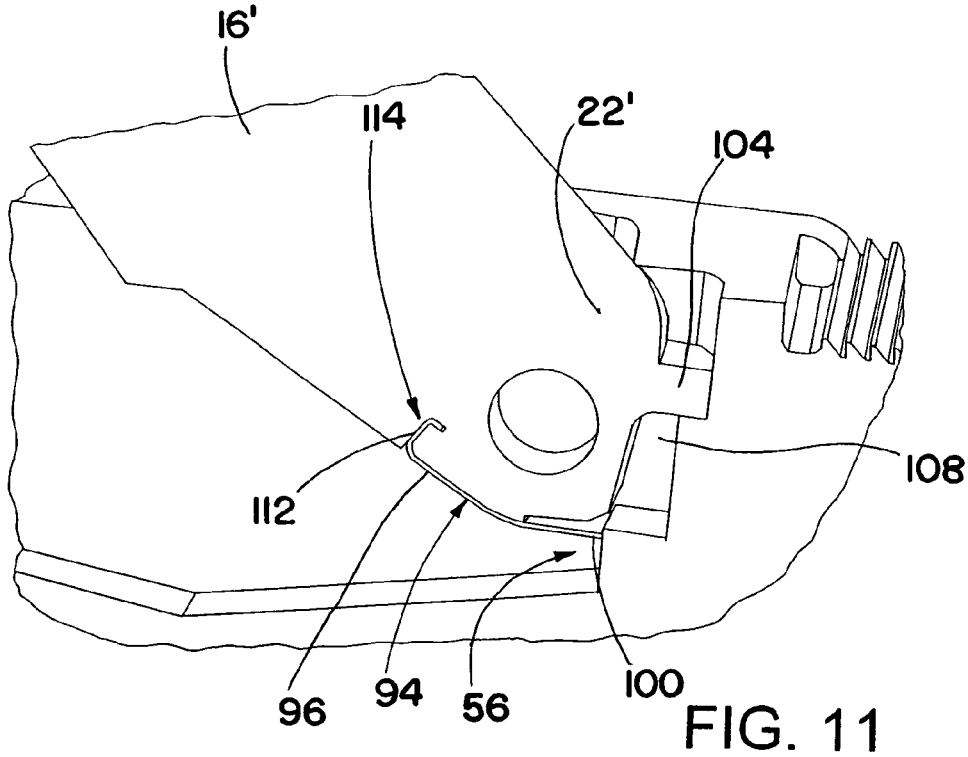
FIG. 11 is another view of the deployment system of FIG. 10.

FIGS. 10 and 11 show a fin 16' with an alternate embodiment hub body portion 22', with a separate resilient tab 94 attached to hub body portion 22'. The resilient tab 94 fulfills much of the same function as the resilient tab 24 (FIG. 1) described above. The resilient tab 94 has an elongate tab body 96, at least part of which is separated from the hub body portion 22' by a slot 98. As the fin 16', the tab body 96 is compressed toward the hub body portion 22'. With enough rotation, a free end 100 of the resilient tab 94 engages a stepped surface 56, preventing reversal of the deployment of the fin 16'. A tip 102 of the resilient tab 94 may press against part of the stepped surface 56 when the resilient tab 94 engages the stepped surface.

The hub body potion 22' also has a protrusion 104 that engages a stop 108 on the guided projectile body 12 when the fin 16' is fully deployed. This prevents overdeployment of the fin 16'.

The resilient tab 94 may be made of a different material than the hub body portion 22'. For instance, the resilient tab 94 may be made of stronger material than that of the hub portion 22'. To give one example, the resilient tab 94 may be made of steel and the hub body portion 22' may be made of aluminum. Alternatively, the resilient tab 94 may be made of the same material as the hub body portion 22'.

The resilient tab 94 may be attached to the hub body portion 22' in any of a variety of suitable ways. The resilient tab 94 may have a bent end 112 at an opposite end from the free end 100. The bent end 112 may be inserted into an tab-receiving slot 114 in the hub body portion 22' to secure the resilient tab 94 to the hub body portion 22'. Alternatively, common fasteners such as screws or other threaded fasteners may be used to secure the resilient tab 94 to the hub body portion 22'.

It will be appreciated that many variations are possible with regard to the above designs. For instance, it may be possible to have a tab that is secured at both ends, and deforms only in a middle portion. Many other shapes and configurations of stepped surfaces and tabs are also possible.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A deployment system for deploying a deployable structure on a guided projectile comprising:

a body of the deployable structure, wherein the body includes:

a hub body portion; and a resilient tab that is attached to the hub body portion at one end; and a guided projectile body having a stepped surface that includes a step with an edge;

wherein the resilient tab presses against the stepped surface during deployment of the deployable structure, and shifts position when going over the step;

wherein the resilient tab is an elongate member having a length in a direction away from where an attached end of the resilient tab attaches to the hub body portion, that is greater than a width or a height of the resilient tab, wherein the width is measured in a plane of the hub body portion; and wherein the elongate member has a protuberance at a free end of the resilient tab that is wider than other parts of the elongate member.

2. The system of claim 1, wherein the body is a single-piece body that includes both the hub body portion and the resilient tab as parts of the single-piece body.

3. The system of claim 1, wherein the hub body portion and the resilient tab are separate pieces.

4. The system of claim 3, wherein the hub body portion and the resilient tab are made of different materials.

5. The system of claim 3, wherein a bent end of the resilient tab fits in a tab-receiving slot in the hub body portion.

6. The system of claim 1, wherein the elongate member includes a straight portion and a curved portion;

wherein the straight portion is a proximal straight portion that includes the attached end; and wherein the curved portion is a distal curved portion that is farther from the attached end than the straight portion.

7. The system of claim 1, wherein a slot between the elongate member and part of the hub body portion has a substantially constant width.

8. The system of claim 1, wherein the resilient tab has a side surface that presses against the stepped surface on a first side of the edge; and wherein the resilient tab side surface does not press against the stepped surface on a second side of the edge.

9. The system of claim 1, wherein the resilient tab has a side surface that presses against the stepped surface on a first side of the edge, when the deployable structure is in a relatively stowed configuration; and wherein the resilient tab has an end surface at the free end configured to engage the stepped surface on a second side of the edge when the deployable structure is in a relatively deployed configuration.

10. The system of claim 8, wherein the side surface and the end surface are on the protuberance.

11. The system of claim 1, wherein the guided projectile body includes a shaft about which the body of the deployable structure rotates.

12. The system of claim 1, wherein the body is at least part of a control surface.

13. The system of claim 1, wherein the protuberance has a side surface that presses against the stepped surface on a first side of the edge, when the deployable structure is in a relatively stowed configuration;

wherein the protuberance has an end surface at the free end configured to engage the stepped surface on a second side of the edge when the deployable structure is in a relatively deployed configuration; and wherein the stepped surface includes a notch on the second side of the edge that secures a portion of the protuberance therein, wherein the portion of the protuberance includes the side surface.

14. The system of claim 13, wherein the protuberance has a squared-off shape that corresponds to the shape of the notch.

15. The system of claim 1, wherein the step is a substantially right angle step.

16. The system of claim 1, wherein the stepped surface has multiple steps that prevents reversal of motion of the deployable structure at multiple locations along its deployment.

17. The system of claim 16, wherein the multiple steps are right angle steps.

18. A deployment system for deploying a deployable structure on a guided projectile comprising:

a single-piece body of the deployable structure, wherein the body includes:

a hub body portion; and a resilient tab that is attached to the hub body portion at one end; and a guided projectile body having a stepped surface having a step with an edge;

wherein the resilient tab presses against the stepped surface during deployment of the deployable structure, and shifts position when going over the step;

wherein the resilient tab is an elongate member having a length in a direction away from where an attached end of the resilient tab attaches to the hub body portion, that is greater than a width or a height of the resilient tab, wherein the width is measured in a plane of the hub body portion;

wherein the elongate member includes a straight portion and a curved portion;

wherein the straight portion is a proximal straight portion that includes the attached end;

wherein the curved portion is a distal curved portion that is farther from the attached end than the straight portion;

wherein the distal curved portion includes a free end of the resilient tab;

wherein a slot between the elongate member and part of the hub body portion has a substantially constant width;

wherein the resilient tab has a side surface that presses against the stepped surface on a first side of the edge, when the deployable structure is in a relatively stowed configuration;

wherein the resilient tab has an end surface at a free end configured to engage the stepped surface on a second side of the edge when the deployable structure is in a relatively deployed configuration;

wherein the resilient tab includes a protuberance at the free end;

wherein the side surface and the end surface are on the protuberance; and wherein the protuberance is wider than other parts of the elongate member.

* * * * *